US005168636A

United States Patent [19]

Golden

[11] Patent Number: 5,168,636

[45] Date of Patent: Dec. 8, 1992

[54] VACUUM STENCIL APPARATUS

[76] Inventor: David C. Golden, 2170 Suffock Ave., Kingman, Ariz. 86401

[21] Appl. No.: 780,959

[22] Filed: Oct. 23, 1991

[51] Int. Cl.[5] ..... B43L 13/20

[52] U.S. Cl. ..... 33/564; 33/562; 248/362; 101/127.1

[58] Field of Search ..... 101/127.1, 128.1, 127, 101/389.1; 118/505; 33/562, 563, 564; 248/362, 363; 269/21

[56] References Cited

U.S. PATENT DOCUMENTS

| | | | |
|---|---|---|---|
| 2,286,473 | 6/1942 | Duggan | 118/505 |
| 2,314,803 | 3/1943 | Wagner et al. | 248/362 |
| 2,363,842 | 11/1944 | Duggan | 118/505 |
| 4,406,246 | 9/1983 | DeMeyer et al. | 118/505 |
| 4,547,406 | 10/1985 | Armstrong | 248/362 |
| 4,843,961 | 7/1989 | Smith | 101/127.1 |

FOREIGN PATENT DOCUMENTS

| | | | |
|---|---|---|---|
| 182142 | 1/1936 | Switzerland | 101/127.1 |
| 0278680 | 2/1952 | Switzerland | 33/564 |

*Primary Examiner*—Allan N. Shoap
*Assistant Examiner*—Alvin Wirthlin
*Attorney, Agent, or Firm*—Leon Gilden

[57] ABSTRACT

A stencil apparatus includes a plurality of letters, wherein each letter includes vacuum porting to effect secure mounting to an underlying surface. A modification of the invention includes a matrix of letters mounted to a single panel to permit simultaneous mounting of the panel to an underlying surface.

5 Claims, 4 Drawing Sheets

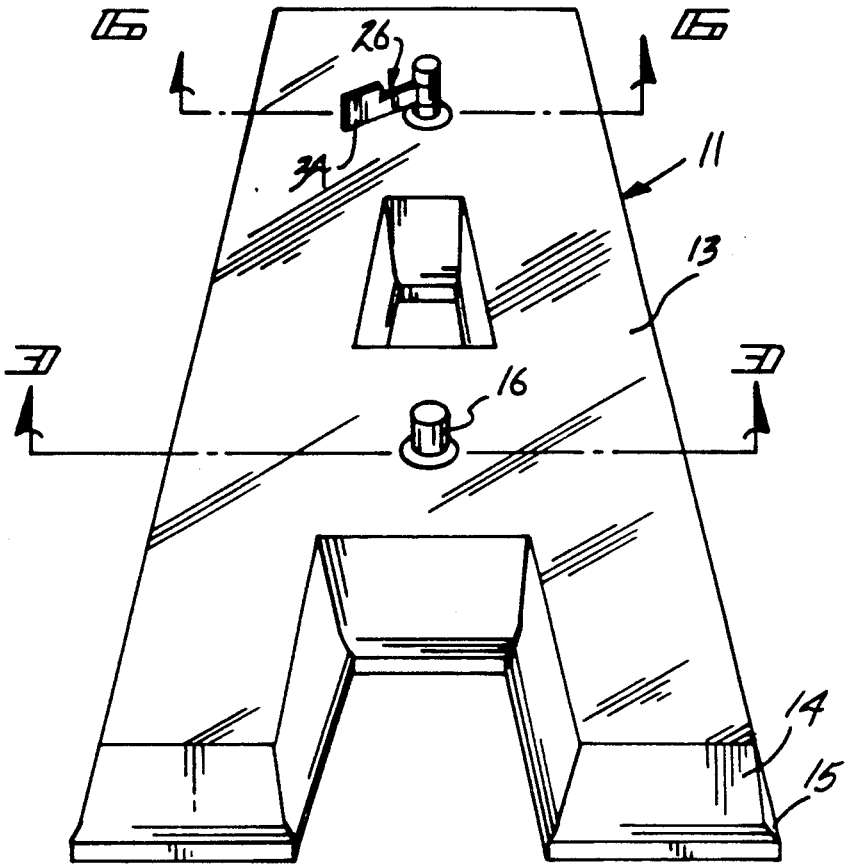
Fig 1
Fig 2
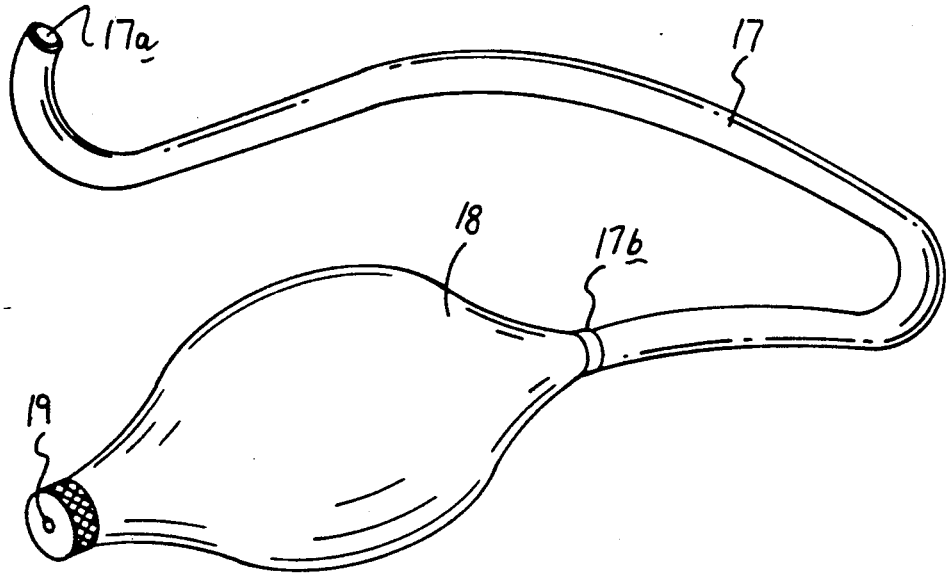

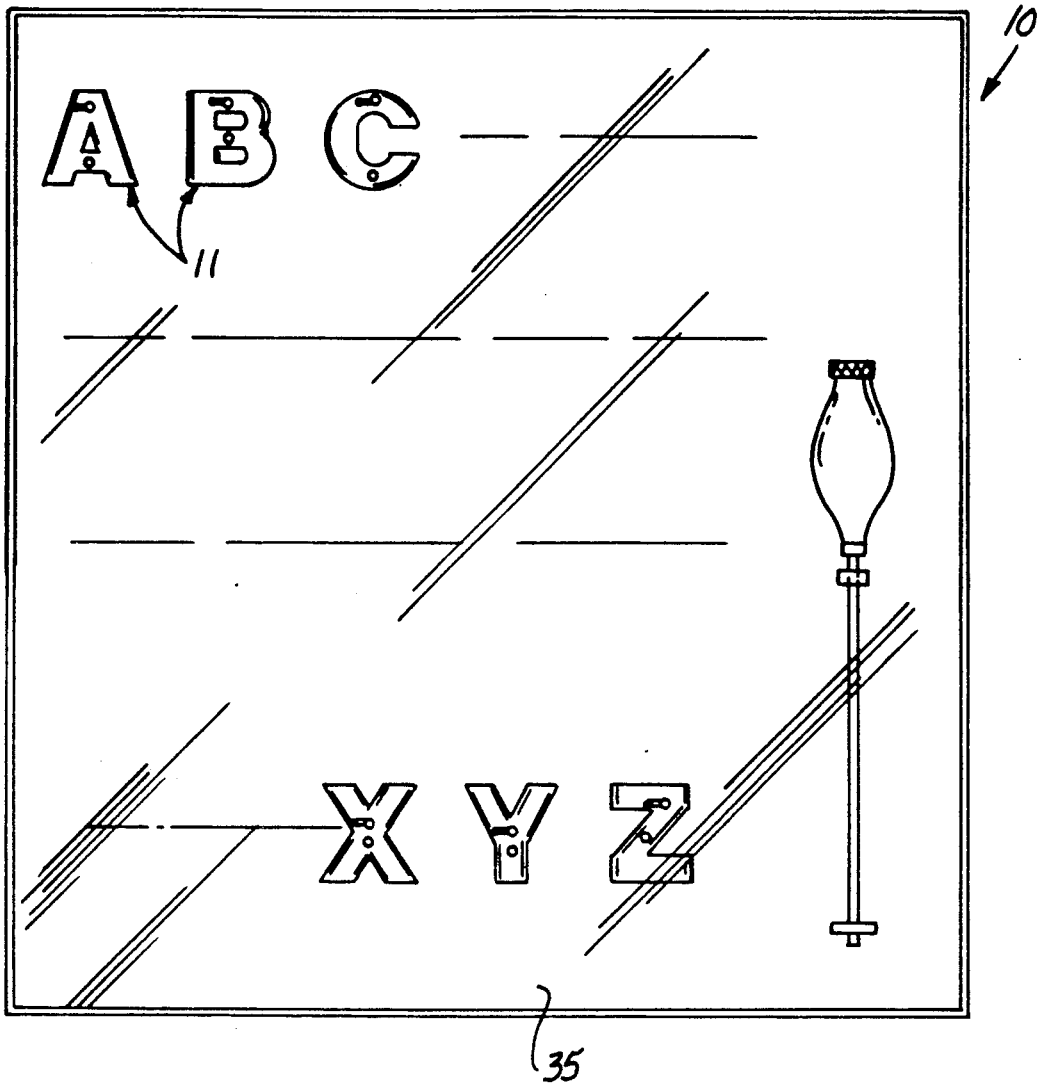
Fig 9
Fig 10
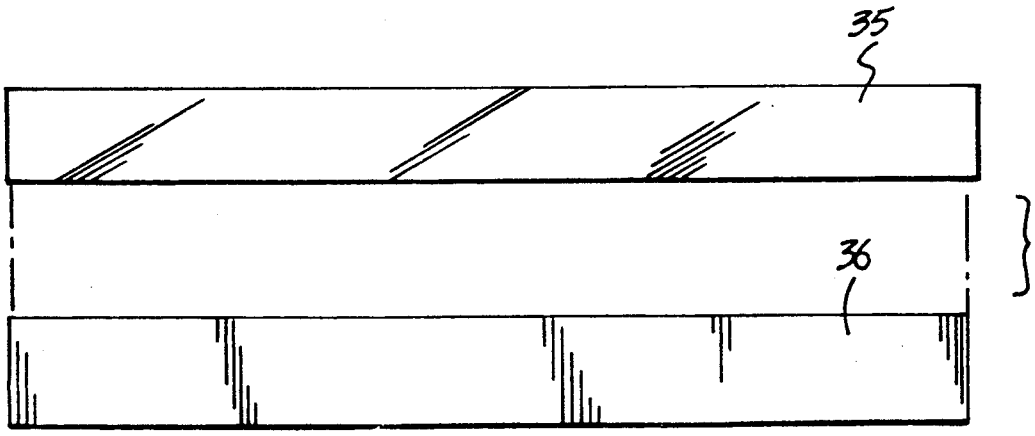

VACUUM STENCIL APPARATUS

BACKGROUND OF THE INVENTION

1. Field of the Invention

The field of invention relates to stencil structure, and more particularly pertains to a new and improved stencil apparatus for permitting the selective and secure mounting of the stencil apparatus to an underlying surface preventing seepage of paint and the like about an associated letter during a painting procedure.

2. Description of the Prior Art

In the stenciling of various lettering to an underlying surface, such as an automobile surface, the surface to be stenciled is typically vertically oriented, wherein paint applied to the stencil lettering is subject to "running" requiring a restenciling and an associated waste of time and man power.

Various masking structure relative to painting and other working procedures are available in the prior art as exemplified by U.S. Pat. No. 4,406,246 to Demeyer, et al. wherein a suction cup member is arranged for securement to an underlying surface.

U.S. Pat. No. 4,843,961 to Smith provides a stencil structure arranged for positioning upon an underlying surface. Selective vacuum and compressed air is arranged for the selective securement and removal of the structure relative to the underlying surface.

As such, it may be appreciated that there continues to be a need for a new and improved stencil apparatus as set forth by the instant invention which addresses both the problems of ease of use as well as effectiveness in construction and in this respect, the present invention substantially fulfills this need.

SUMMARY OF THE INVENTION

In view of the foregoing disadvantages inherent in the known types of stencil apparatus now present in the prior art, the present invention provides a stencil apparatus wherein the same utilizes a valved vacuum port in association with a vacuum release to permit selective securement of individual stencil letters to an underlying surface. As such, the general purpose of the present invention, which will be described subsequently in greater detail, is to provide a new and improved stencil apparatus which has all the advantages of the prior art stencil apparatus and none of the disadvantages.

To attain this, the present invention provides a stencil apparatus including a plurality of letters, wherein each letter includes vacuum porting to effect secure mounting to an underlying surface. A modification of the invention includes a matrix of letters mounted to a single panel to permit simultaneous mounting of the panel to an underlying surface.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved stencil apparatus which has all the advantages of the prior art stencil apparatus and none of the disadvantages.

It is another object of the present invention to provide a new and improved stencil apparatus which may be easily and efficiently manufactured and marketed.

It is a further object of the present invention to provide a new and improved stencil apparatus which is of a durable and reliable construction.

An even further object of the present invention is to provide a new and improved stencil apparatus which is susceptible of a low cost of manufacture with regard to both materials and labor, and which accordingly is then susceptible of low prices of sale to the consuming public, thereby making such stencil apparatus economically available to the buying public.

Still yet another object of the present invention is to provide a new and improved stencil apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is an isometric illustration of a letter configuration housing utilized by the invention.

FIG. 2 is an isometric illustration of the air exhaust bulb structure utilized by the invention.

FIG. 9 is an isometric illustration of the invention mounted upon a single transparent plate.

FIG. 10 is an orthographic view, taken in elevation, of the transparent plate for positioning upon a surface to be stenciled.

DESCRIPTION OF THE PREFERRED EMBODIMENT

Figure 3:
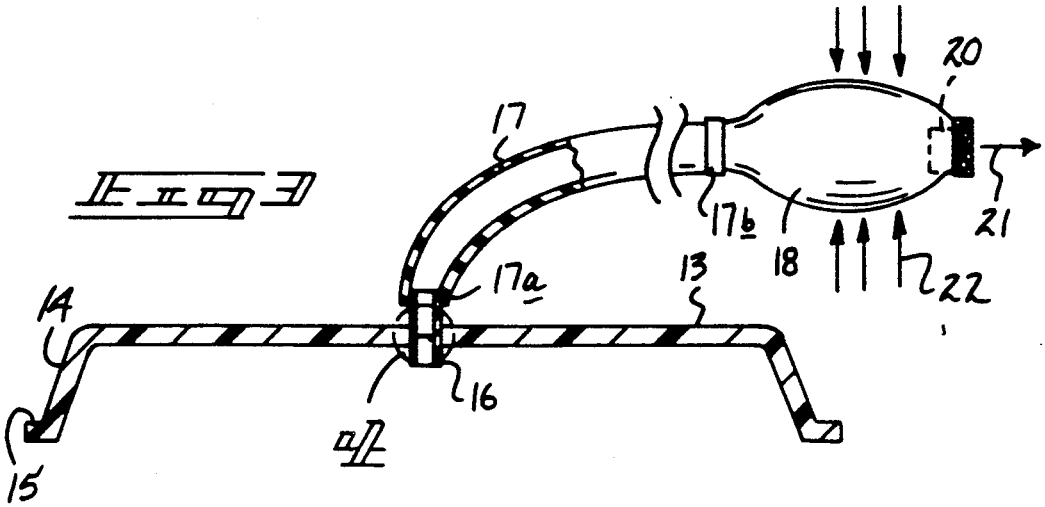
FIG. 3 is an orthographic cross-sectional illustration, taken along the lines 3—3 of FIG. 1 illustrating the exhaust bulb structure mounted to the associated exhaust conduit.
Figure 4:
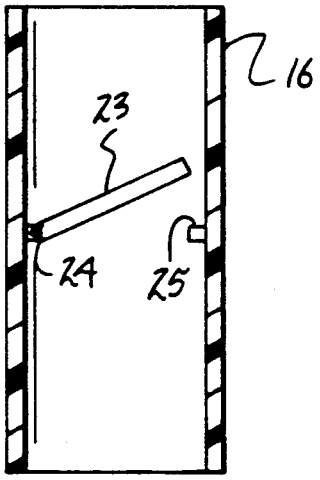
FIG. 4 is an enlarged orthographic cross-sectional illustration of the exhaust conduit utilized by the invention in an opened configuration.
Figure 5:
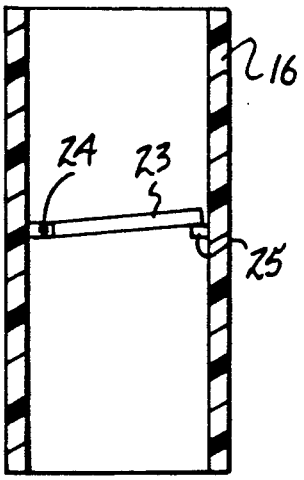
FIG. 5 is an orthographic cross-sectional illustration of the exhaust conduit in a second closed configuration.
Figure 6:
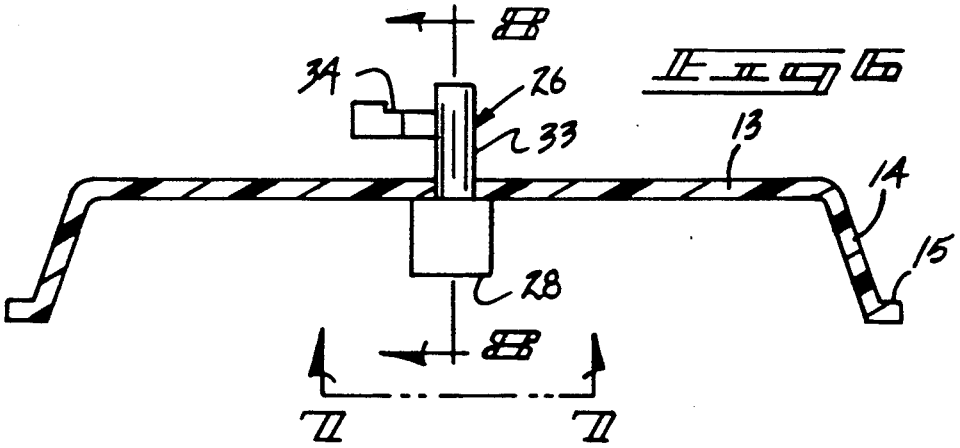
FIG. 6 is an orthographic cross-sectional illustration, taken along the lines 6—6 of FIG. 1 in the direction indicated by the arrows.
Figure 7:
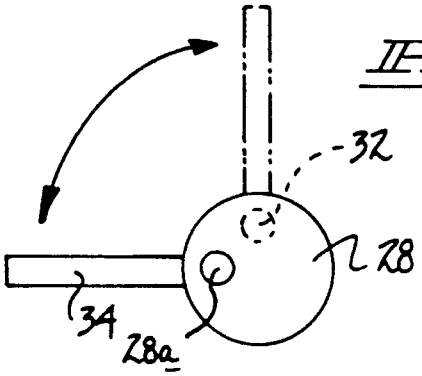
FIG. 7 is an orthographic view, taken along the lines 7—7 of FIG. 6 in the direction indicated by the arrows.
Figure 8:
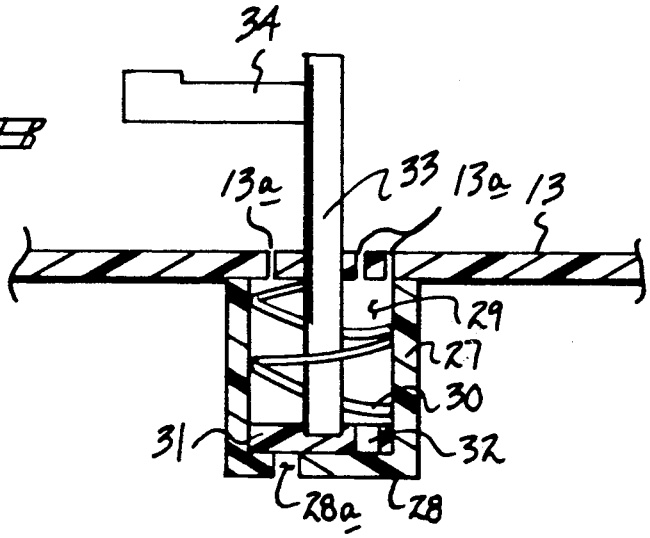
FIG. 8 is an orthographic cross-sectional illustration, taken along the lines 8—8 of FIG. 6 in the direction indicated by the arrows.

With reference now to the drawings, and in particular to FIGS. 1 to 10 thereof, a new and improved stencil apparatus embodying the principles and concepts of the present invention and generally designated by the reference numeral 10 will be described.

More specifically, the stencil apparatus 10 of the instant invention essentially comprises a letter configuration housing 11, including a rigid top wall 13, with a continuous flexible side wall 14 extending downwardly of the top wall to define an enclosed chamber between the top wall 13, the side wall 14, and a surface 36 to be stenciled, as illustrated in FIG. 10. The side wall 14 includes a side wall flange 15 extending exteriorly of a lower terminal end of the side wall 14 to enhance pneumatic sealing of the side wall and associated enclosed chamber relative to the underlying surface. The top wall 13 includes a top wall rigid exhaust conduit 16 directed into the enclosed chamber and through the top wall for securement to a flexible exhaust conduit 17. The exhaust conduit 17 includes a first terminal end 17*a* for securement to the exhaust conduit 16, with a second terminal end 17*b* secured to a squeeze bulb 18. The squeeze bulb 18 is formed of a deformable, shape retentive material that includes an exhaust port 19 directed through the bulb at a distal end thereof spaced from the second terminal end 17*b*. A check valve 20 is secured relative to the exhaust port 19 to permit exhaust air 21 to be released through the exhaust port 19 only upon deforming pressure 22 applied to the squeeze bulb 18.

The exhaust conduit (16 see FIG. 3) includes an exhaust conduit check valve cylindrical plate 23 that is provided with a cylindrical plate hinge 24 to hingedly mount the cylindrical plate 23 within the exhaust conduit 16 at a perimeter edge portion of the cylindrical plate 23 within the exhaust conduit 16. A cylindrical plate abutment ledge 25 mounted within exhaust conduit 16 provides for abutment of the plate to prevent air from being directed into the enclosed chamber 13 through the exhaust conduit 17 when the bulb is deformed as illustrated in FIG. 3 positioned in the first position effecting closure of the exhaust conduit 16 to a second raised position as a consequence of the squeeze bulb 18 being undeformed in a manner such as illustrated in the FIG. 3.

A release valve 26, (FIG. 6) is directed through the top wall 13 spaced from the exhaust conduit 16. The release valve 26 includes a cylindrical release valve housing 27 formed with a housing floor 28, with an aperture 28*a* directed through the housing floor radially spaced from an axial center of the floor 28. A cylindrical release valve housing cavity 29 is thereby defined within the cylindrical housing 27 to include a spring 30 that is captured between a bottom surface of the rigid top wall 13 and a cylindrical valve plate 31 mounted to an interior surface of the floor 28 within the cavity 29. The valve plate 31 includes a valve plate bore 32 that is spaced an equal radial distance from an axial center of the cylindrical housing 27, whereupon rotation of the cylindrical valve plate 31 by rotation of the post 33 by the handle 34, the bore 32 is selectively aligned with the aperture 28*a* to effect release of vacuum by permitting a flow of air through the housing 27 by apertures 13*a* positioned through the floor 13 above the floor 28. The post 33, as illustrated, is coaxially mounted and orthogonally oriented relative to the valve plate 31, with the handle 34 orthogonally mounted to an upper terminal end of the post 33 above the rigid top wall 13.

In the FIG. 9, a matrix of the letter configuration housing 11 is provided to define the English alphabet, each including an associated exhaust conduit 16 and a release valve 26. The transparent mounting plate 35 may therefore be positioned above a surface 36 to be stenciled, with each letter 11 selectively secured with the transparent plate permitting visual alignment of each stencil letter 11 or letter configuration housing 11 positioned in relative alignment relative to one another.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A stencil apparatus, comprising, at least one letter configuration housing, the letter configuration housing including a rigid top wall, with the rigid top wall including a continuous downwardly extending flexible side wall, and the flexible side wall arranged for mounting upon a surface to be stenciled to define an enclosed chamber between the surface, the side wall, and the top wall, and the side wall including a flexible side wall flange extending exteriorly of the side wall to provide for an enlarged contact surface to enhance sealing of the housing to the surface, and the top wall including a rigid exhaust conduit directed through the top wall extending above the top wall, with the rigid exhaust conduit including a flexible exhaust conduit selectively securable to the rigid exhaust conduit exteriorly of the enclosed chamber, with the flexible exhaust conduit including a first terminal end secured to the rigid exhaust conduit, and a second terminal end mounting a deformable shape retentive squeeze bulb, the squeeze bulb including an exhaust port directed through the squeeze bulb at a distal end of the squeeze bulb spaced from the second terminal end, with the exhaust port including a check valve preventing directing of air into the squeeze bulb for directing into the flexible exhaust conduit.

2. An apparatus as set forth in claim 1 wherein the rigid top wall includes a release valve, the release valve including a cylindrical housing mounted to the rigid top wall extending below the top wall, with the cylindrical release valve housing including a housing floor, the housing floor including an aperture, wherein the aperture is radially spaced from an axial center of the housing floor, and the cylindrical housing defining a housing cavity between the housing floor and the rigid top wall, and a spring captured between the housing floor and the rigid top wall, and a cylindrical valve plate rotatably mounted on the housing floor, with the cylindrical valve plate including a valve plate bore, the valve plate bore arranged for selective alignment with the aperture.

3. An apparatus as set forth in claim 2 including a post fixedly and coaxially mounted to the cylindrical valve plate extending through the housing cavity extending above the rigid top wall, to permit rotation of the valve plate relative to the housing floor, with the post including a handle fixedly mounted to an upper terminal end thereof, and the rigid top wall including a plurality of rigid top wall apertures directed through the rigid top wall spaced above the housing floor.

4. An apparatus as set forth in claim 3 wherein the rigid exhaust conduit includes a cylindrical plate hingedly mounted within the rigid exhaust conduit, with the rigid exhaust conduit including an abutment ledge fixedly mounted within the rigid exhaust conduit, wherein the abutment ledge positions the cylindrical plate in a first horizontal position and permits deflection of the cylindrical plate to a second position spaced from the first position upon deforming of the squeeze bulb.

5. An apparatus as set forth in claim 4 including a plurality of letter configuration housings mounted within a transparent mounting plate to permit visual observation and alignment of each letter configuration housing relative to one another relative to the surface.

* * * * *